US005934492A

United States Patent [19]

Jones

[11] Patent Number: 5,934,492

[45] **Date of Patent: *Aug. 10, 1999**

[54] SENIOR FRIENDLY CHILD RESISTANT MEDICATION CONTAINERS

[76] Inventor: William Thomas Jones, 38 Redford Road, London, Ontario, Canada, N3X 3V5

[ * ] Notice: This patent is subject to a terminal disclaimer.

[21] Appl. No.: 09/035,090

[22] Filed: Mar. 5, 1998

Related U.S. Application Data

[63] Continuation-in-part of application No. 08/812,835, Mar. 6, 1997, Pat. No. 5,819,968.

[51] Int. Cl.[6] ..... B65D 55/02

[52] U.S. Cl. ..... 215/222; 215/230; 215/346; 116/309

[58] Field of Search ..... 215/204, 214, 215/216–220, 222–225, 230, 274, 276–277, 332, 349, 350–351, 11.1, 11.3, 11.6, 343, 345–346, 301, 342, DIG. 1, 43, 45; 220/293, 281, 296, 302, 304; 116/308, 306, 309, 311, 312, 315, 318

[56] References Cited

U.S. PATENT DOCUMENTS

| | | | |
|---|---|---|---|
| 3,432,065 | 3/1969 | Bugla | 215/332 |
| 3,716,161 | 2/1973 | Julian et al. | 215/342 X |
| 3,756,445 | 9/1973 | Hedgewick | 215/222 |
| 4,346,809 | 8/1982 | Kusz | 215/222 X |
| 4,489,834 | 12/1984 | Thackery | 215/220 |
| 4,528,933 | 7/1985 | Allen | 116/308 |
| 4,641,759 | 2/1987 | Kelley | 215/220 |
| 4,749,093 | 6/1988 | Trick | 215/220 |
| 4,753,189 | 6/1988 | Mastman et al. | 215/222 |
| 4,768,682 | 9/1988 | Friedrich | 215/222 X |
| 4,913,083 | 4/1990 | Valvo et al. | 116/308 |
| 5,732,836 | 3/1998 | Barker et al. | 215/230 |
| 5,819,968 | 10/1998 | Jones | 215/230 X |

*Primary Examiner*—Stephen K. Cronin
*Assistant Examiner*—Nathan Newhouse
*Attorney, Agent, or Firm*—Rogers & Scott

[57] ABSTRACT

A medication container has a tubular container body with an open upper end, and a cap detachably securable to the upper edge of the container body by clockwise rotation relative thereto, the cap and the container body having mutually engageable stops preventing anti-clockwise opening rotation of the cap relative to the container body when the cap is in an upper position relative to the container body. A cap liner of resilient material within the cap has a peripheral portion engageable with the upper end of the container body to close the upper end, the cap liner also having a central button portion in a central aperture in the cap for manual engagement by a person wishing to open the container. The cap is normally engaged by the cap liner, when the cap is detachably secured to the container body, to maintain the cap in the upper position relative to the container body, whereby downward manual pressure on the central button portion of the cap liner causes resilient deformation of the cap liner away from the cap to permit the cap to be depressed from its upper position and thereby permit counter-clockwise opening rotation of the cap relative to the container body.

15 Claims, 4 Drawing Sheets

SENIOR FRIENDLY CHILD RESISTANT MEDICATION CONTAINERS

This invention relates to medication containers, and this application is a continuation-in-part of U.S. patent application Ser. No. 08/812,835 filed Mar. 6, 1997 now U.S. Pat. No. 5,819,968 issued Oct. 13, 1998.

BACKGROUND OF THE INVENTION

Medication containers with child resistant closures, i.e. which resist opening by children, are well known. However, the features which render a closure child resistant often cause closure to be difficult to open by seniors, i.e. older people, especially those with weak manual dexterity.

It is also known to provide medication containers with mechanism operated by opening and/or closure to indicate the time the next dosage of medication is to be taken, such information being especially useful for seniors with failing memories as well as of course for others.

It is therefore an object of the invention to provide a medication container which is both senior friendly and child resistant, which may also be provided with mechanism operated by opening and/or closure to indicate the next dosage time, and with which pre-packaged medication can be used.

SUMMARY OF THE INVENTION

According to the invention, a medication container has a tubular container body having an open upper end, and a cap detachably securable to the upper end of the container body by clockwise rotation relative thereto. The cap and the container body have mutually engageable stops which prevent anti-clockwise opening rotation of the cap relative to the container body when the cap is in an upper position relative to the container body. A cap liner of resilient material is located within the cap and has a peripheral portion engageable with the upper end of the container body to close the upper end, the cap liner also having a central button portion in a central aperture in the cap for manual engagement by a person wishing to open the container. The cap is normally engaged by the cap liner, when the cap is detachably secured to the container body, to maintain the cap in the upper position relative to the container body. Downward manual pressure on the central button portion of the cap liner causes resilient deformation of the cap liner away from the downwardly extending wall of the cap to permit the cap to be depressed from its upper position and thereby permit counter-clockwise opening rotation of the cap relative to the container body.

Thus, when the container is closed, a child cannot simply rotate the cap in a counter-clockwise direction to open the container, but the central button portion of the cap liner can be depressed to enable the cap also to be depressed and subsequently rotated in an opening manner, thereby facilitating opening movement by people such as seniors with weak manual dexterity. The container can also be opened by depressing the cap directly and then rotating the cap in the opening manner.

The cap may have a downwardly extending wall adjacent to the aperture and engaged by the cap liner, when the cap is detachably secured to the container body, to maintain the cap in the upper position relative to the container body, whereby downward manual pressure on the central button portion of the cap liner causes resilient deformation of the cap liner away from the downwardly extending wall of the cap to permit the cap to be depressed from its upper position and thereby permit counter-clockwise opening rotation of the cap relative to the container body.

The central button portion may have a circumferentially extending lateral projection which engages the cap during downward movement of the central button portion to depress the cap in an upper position and normally spaced above the top of the cap by a pre-determined distance when the cap is secured to the container body to permit axial movement of the cap liner relative to the cap.

The cap and the cap liner may have inter-engaging mechanism provided on an internal surface of the downward extending wall of the cap and an external surface of a peripheral wall of the central button portion of the cap liner to prevent rotational movement therebetween when the cap is rotated in one direction relative to the container body and permitting relative movement therebetween when the cap is rotated in an opposite direction relative to the container body, the cap and the cap liner having indicia which indicates the next dosage time when the cap is rotated in the opposite direction.

The inter-engaging mechanism may prevent relative movement between the cap and the cap liner when the cap is rotated in the clockwise closing direction and permit relative rotation between the cap and the cap liner when the cap is rotated in the anti-clockwise open direction.

When the cap is detached from the container body, downward manual pressure on the central button portion of the cap liner may cause axial movement of the cap liner relative to the cap to disengage the inter-engaging mechanism to permit relative rotation between the cap and the cap liner.

The inter-engaging mechanism may comprise circumferentially spaced ribs on the said side wall of the cap or the cap liner and a series of ratchet teeth engageable therewith extending around the said wall of the cap liner or the cap. The ratchet teeth may be located only on a lower portion of the peripheral wall of the cap liner and have upper surfaces engaged by lower ends of ribs on the outer surface of the downwardly extending wall of the cap to provide the ratchet action. The upper surface of the ratchet teeth may be circumferentially upwardly inclined and radially outwardly downwardly inclined, with the lower ends of the ribs being inclined in a complementary manner.

The peripheral portion of the cap liner may have downwardly open U-shape for engaging the upper end of the container body to close the upper end, the peripheral portion merging in the radially inward direction with a first liner portion of upwardly open U-shape with merges in turn with an intermediate liner portion of downwardly open U-shape which merges in turn with a second liner portion of upwardly opened U-shape, the second liner portion of upwardly open U-shape merging with a lower end of the downwardly extending wall of the central button portion.

The cap liner may have a series of circumferentially spaced posts extending upwardly therefrom for engagement with the cap, when the cap is detachably secured to the container body, to maintain the cap in the upper position relative to the container body, whereby downward manual pressure on the central button portion of the cap liner causes resilient deformation of the cap liner away from the downwardly extending wall of the cap to permit the cap to be depressed from its upper position and thereby permit counter-clockwise opening rotation of the cap relative to the container body. The posts may extend upwardly from the intermediate liner portion of downwardly open U-shape.

The container body may have a radially outwardly extending flange portion and a peripheral wall extending upwardly from a radially outer edge thereof, the peripheral wall having an upper edge providing the upper end of the container engageable by a peripheral portion of the cap liner, the medication container also having a detachable body liner located within the container body and having a tubular liner body with a closed lower end and an opened upper end, the upper end of the body liner having a radially outwardly extending flange located on the radially outwardly extending flange portion of the container body. The cap liner may sealingly engage the radially outwardly extending flange of the body liner when the cap is in the closed position. For example, the liner portion of upwardly open U-shape may sealingly engage an inner surface of the peripheral wall of the container body when the cap is in the closed position.

Resilient deformation of the cap liner away from the downwardly extending wall of the cap caused by downward pressure on the central button portion of the cap liner may at least partially disengage the inter-engaging mechanism to facilitate opening movement of the cap.

BRIEF DESCRIPTION OF THE DRAWINGS

Embodiments of the present invention will now be described, by way of example, with reference to the accompanying drawings, of which.

DESCRIPTION OF PREFERRED EMBODIMENTS

Figure 1:
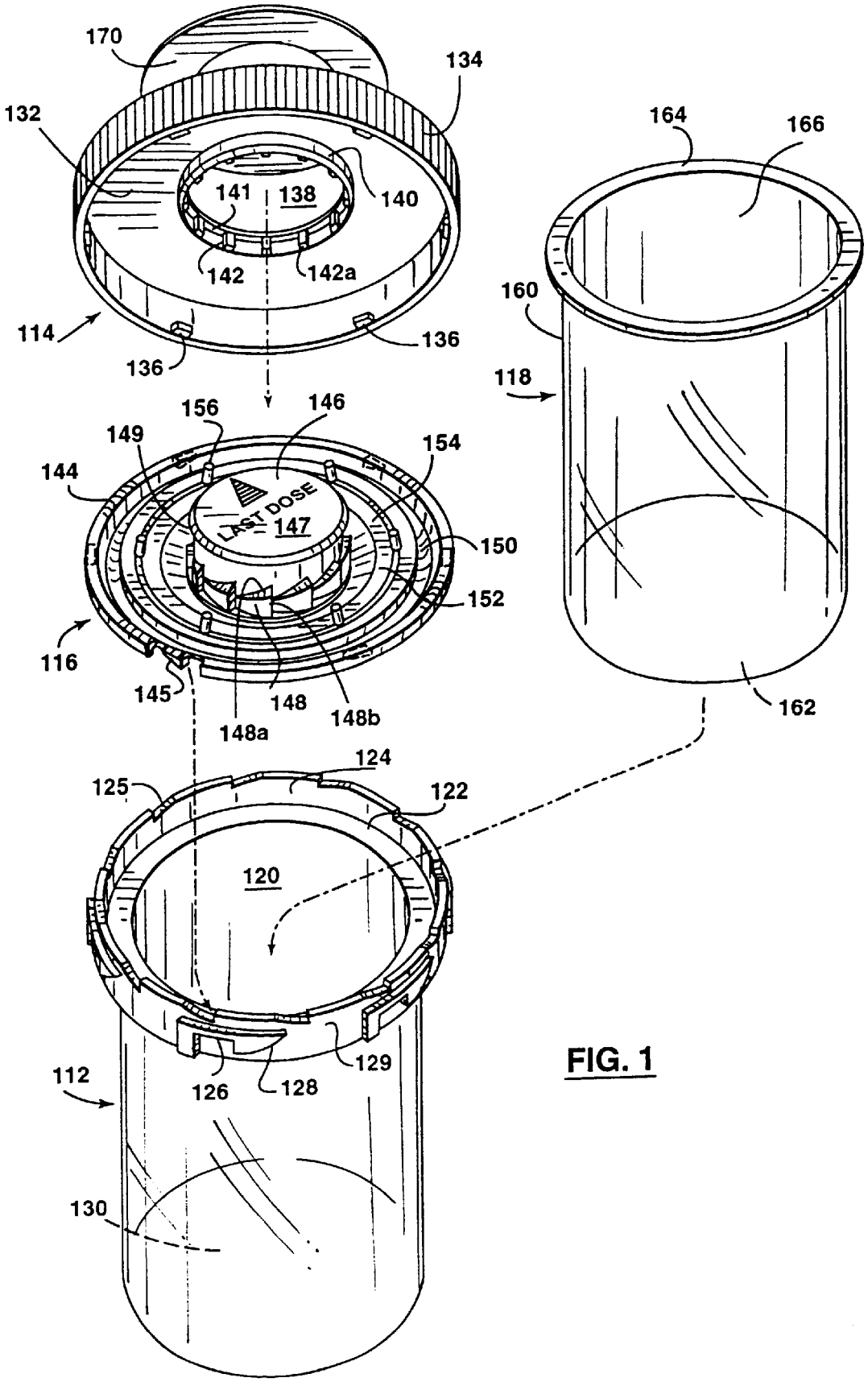
FIG. 1 is an exploded perspective view of a medication container in accordance with one embodiment of the invention.

Referring to the drawings, FIG. 1 shows a medication container having a tubular container body 112, a cap 114, a cap liner 116 and a disposable body liner 118. The container body 112 is of plastic material and has an open upper end 120 with a peripheral outwardly extending flange 122 and an upwardly extending wall 124 extending around the outer edge of the flange 122. The upper edge of the wall 124 has a circumferentially extending series of ratchet teeth 125, there being twelve such teeth in this embodiment. The external surface of the wall 124 has a series of circumferentially-spaced downwardly-opened recesses 126, each with an adjacent upwardly inclined ramp 128, and each ramp 128 being followed by a space 129, there being six such recesses in this embodiment. The lower end 130 of the container body 112 is closed.

The cap 114 is of plastic material and has a circular top portion 132 with a downwardly extending peripheral wall 134 having a series of circumferentially-spaced inwardly-projecting lugs 136 at its lower end equal in number to the number of recesses 126 in the external surface of the wall 124 at the upper end of the container body 112. The circular top portion 132 of the cap 114 also has a circular aperture 138 and a short downwardly extending inner wall 140 surrounding the aperture 138. The internal diameter of the inner wall 140 is slightly larger than the diameter of the central aperture 138 so as to provide an inner annular portion 141 of the circular top portion 138 projecting radially inwardly beyond the inner wall 140. The inner wall 140 has a series of circumferentially spaced vertical ribs 142 which extend radially inwardly from the inner wall 140 for a distance slightly less than the inner annular portion 141 of the circular top portion 132 of the cap 114, there being twelve such ribs 142 in this embodiment.

The cap liner 116 is of resilient plastic material and has a peripheral portion 144 of downwardly-open U-shape which receives and engages the upper end of the wall 124 of the container body 112 to close the upper end thereof. The peripheral portion 144 of the cap liner 116 has a series of circumferentially spaced downwardly extending projections 145 positioned to engage the ratchet teeth 125 on the upper edge of the wall 124 of the container body 112, there being six such projections in this embodiment. The cap liner 116 also has a central button portion 146 which projects upwardly through the central aperture 138 in the cap 114. The central button portion 146 has a series of ratchet teeth 148 extending around the lower portion of the exterior of the side wall 147 thereof, each tooth 148 having an inclined upper surface 148a engageable by the lower ends of the vertical ribs 142 on the cap 114, there being twelve such teeth in this embodiment.

The inclined upper surface 148*a* of each ratchet tooth 148 is both circumferentially upwardly inclined and also radially outwardly downwardly inclined. The lower end 142*a* of each rib 142 is inclined in a complementary manner for engagement with the inclined upper surfaces 148*a* of the ratchet teeth 148. The inclined upper surface 148*a* of each ratchet tooth 148 is followed by a vertical surface 148*b*. The topmost portion of the side wall 147 has an annular bead 149 extending therearound which is slightly larger in diameter than the diameter of the central aperture 138 in the cap 114. During assembly, the bead 149 is snapped through the aperture 138. The bead 149 may extend continuously around the topmost portion of the side wall 147 or may be interrupted.

Figure 6:
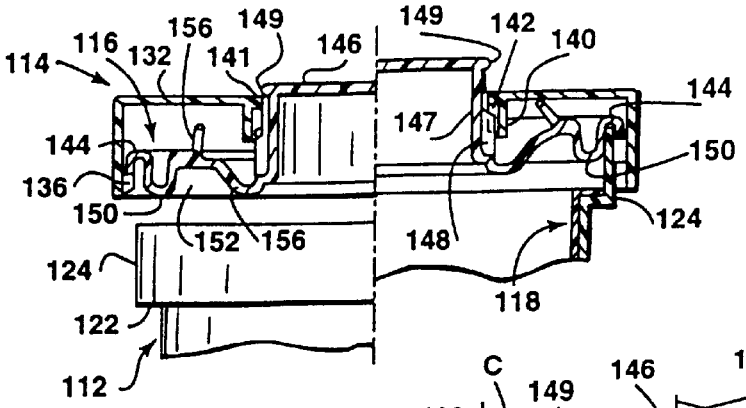
FIG. 6 is a side view, partly in section, of the cap and cap liner and the upper portion of the container body, with the left hand side of the figure showing the configuration of the cap liner before the cap contacts the container body, and with the right hand side of the figure showing the configuration of the cap liner when the cap has been secured to the container body.
Figure 7:
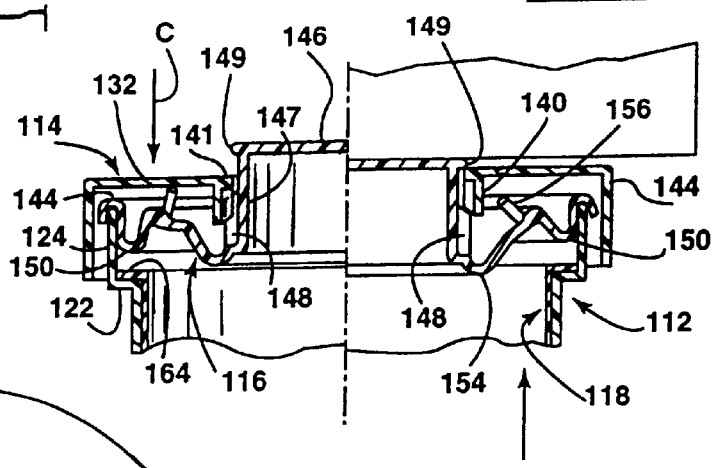
FIG. 7 is a similar view to FIG. 6, but with the left hand side of the figure showing the configuration of the cap liner when the cap is being removed without pushing down the central button of the cap liner, and with the right hand side of the figure showing the configuration of the cap liner when the cap is being removed with the central button of the cap liner first being depressed.

As shown more clearly in FIGS. 6 and 7, the downwardly-open U-shaped peripheral portion 144 of the cap liner 116 merges with an outer U-shaped upwardly-open portion 150 which in turn merges with an intermediate downwardly-open U-shaped portion 152, which in turn merges with an inner upwardly-open U-shaped portion 154, which merges with the lower end of the side wall 147 of the central button portion 146. The intermediate downwardly-open U-shaped portion 152 has a series of circumferentially spaced posts 156 extending upwardly therefrom.

The disposable body liner 118 has a tubular body 160 which is a press fit in the container body 112, the tubular body 160 having a closed lower end 162 and a peripheral radially outwardly extending flange 164 at its upper open end 166.

The medication container also has an annular label 170 which can be secured to the central top portion 132 of the cap 114 so as to surround the aperture 138, as will be described in more detail later.

Figure 8:
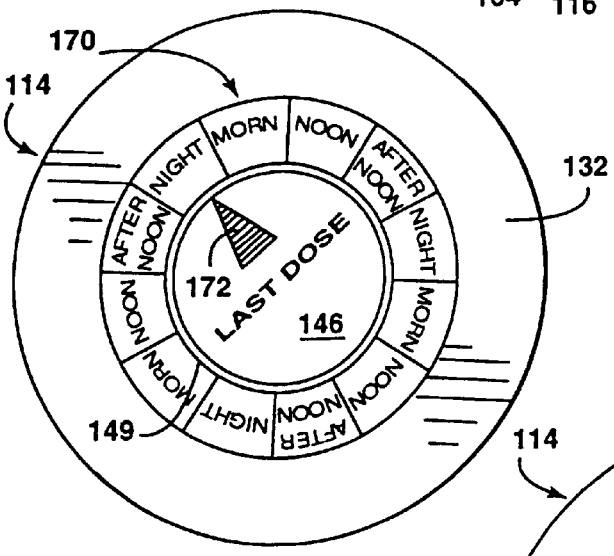
FIG. 8 is a plan view of the container before opening, with the "last dose" arrow being in the "night" position.
Figure 9:
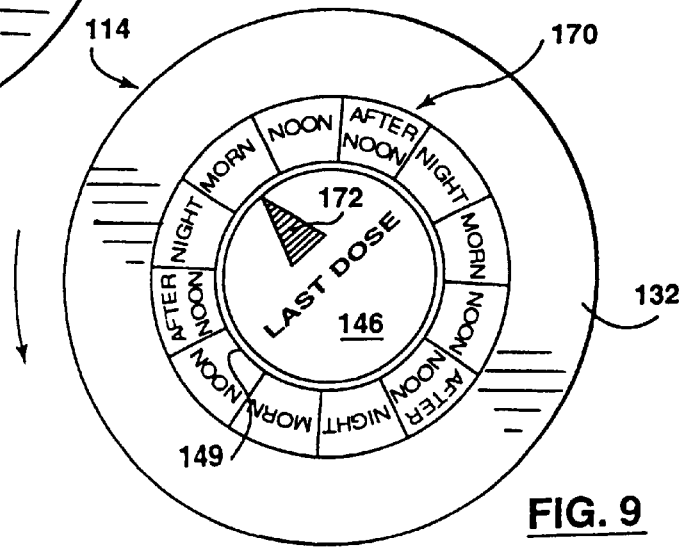
FIG. 9 is a similar view showing the cap subsequently rotated to the open position, with the "last dose" arrow having moved to the "morn" position (and remaining there when the cap has been rotated to the close position)

FIGS. 8 and 9 show the annular label 170, which is preferably a self-adhesive label, secured to the top of the circular portion 132 of the cap 114 so as to surround the central button 146 of the liner 116. As shown, the label 170 has various sectors showing dosage times. The top of the central button 146 bears the words LAST DOSE and an indicator arrow 172. Alternatively, this information may be on a label secured to the top of the central button 146.

Figure 2:
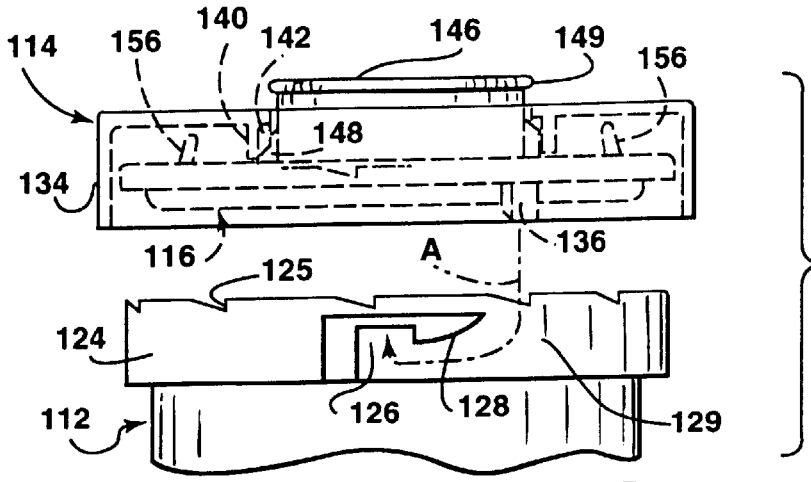
FIG. 2 is a diagrammatic side view of the cap positioned above the upper portion of the container body, with parts of the cap and the cap liner therein being shown in dotted outline.

FIG. 2 and the left hand side of FIG. 6 show the cap 114 and cap liner 116 before attachment to the container body 112. The cap liner 116 has been assembled with the cap 114 by snapping the outer peripheral portion 144 of the cap liner 166 past the lugs 136 on the cap 114, and also by snapping the peripheral bead 149 on the central button portion 146 of the cap liner 116 through the central aperture 138 in the cap 114 so that the central button portion 146 projects above the circular top portion 132 of the cap 114. The ribs 142 on the inner wall 140 of the cap 114 are then engaged with the ratchet teeth 148 on the lower part of the outer surface of the wall 147 of the central button portion 146 of the cap liner 116.

The cap liner 116 can move vertically a limited amount in the cap 114, with downward movement of the cap liner 116 in the cap 114 being limited by engagement of the button bead 149 with the inner annular portion 141 of the cap 114 and by the engagement of the outer edge of the outer peripheral portion 144 of the liner 116 with the lugs 136 on the inside of the peripheral wall 134 of the cap 114. Upward movement of the liner 116 relative to the cap 114 is limited by engagement of the liner 116 with the lower end of the wall 140 of the cap 114 and/or by the engagement of the posts 156 on the liner 116 with the underside of the circular top portion 132 of the cap 114 although, as will be described later, the liner 116 can be resiliently deformed to permit further downward movement of the cap 114 relative thereto.

The ribs 142 on the cap 114 are always engaged with the ratchet teeth 148 on the liner 116, regardless of the actual vertical position of the liner 116 in the cap 114, when the cap 114 is not on the container body 112 and the cap liner 116 is not deformed, so as to prevent the liner 116 from being able to "free wheel" relative to the cap 114 when the cap 114 is not on the container body. When the cap 114 is not on the container body 112, the cap liner 116 can be intentionally rotated in a clockwise manner relative to the cap 114 to set the arrow 172 on the central button 146 in the correct position relative to the annular label 170 on the cap 114. Rotation of the cap liner 116 in a clockwise manner relative to the cap 114 can be permitted and rotation of the cap liner 116 in an anti-clockwise manner relative to the cap 114 facilitated by pushing down on the central button 146 of the cap liner 116 to cause axial movement of the cap liner 116 relative to the cap 114 to disengage the inter-engaging mechanism.

Figure 3:
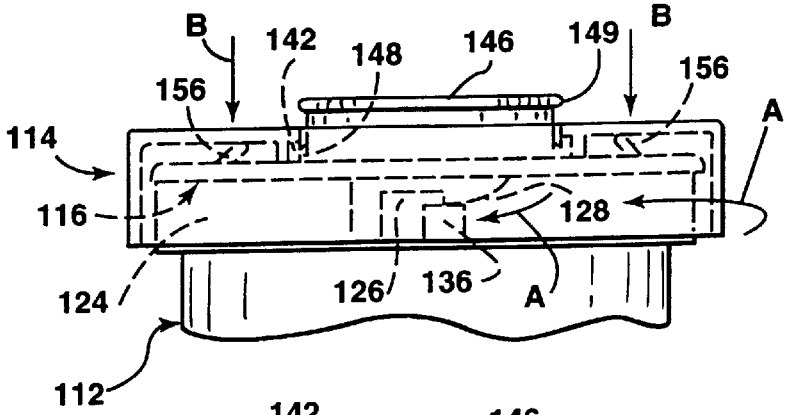
FIG. 3 is a similar view but showing the cap being secured to the container body.

To close the container, the cap 114 with liner 116 is placed on top of the container body 112 and rotated clockwise relative thereto, with some downward pressure, as indicated by the arrows A and B in FIGS. 2 and 3, so that each lug 136 on the cap 114 (after passing into a space 129) engages a ramp 128 on the container body 112. During this portion of the closing movement, the outer downwardly open U-shaped portion 144 of the liner 116 engages the upper edge of the wall 124 of the container body 112, and continued downward pressure on the cap 114 causes the cap 114 to exert downward pressure on the liner posts 156 with consequent resilient deformation of the liner 116. Each lug 136 then moves into an adjacent recess 126, thereby permitting slight upward movement of the cap 114 relative to the container body 112 when downward pressure on the cap 114 is removed, such upward movement of the cap 114 being caused by engagement of the posts 156 with the top portion 132 of the cap 114. The bead 149 surrounding the upper end of the central button portion 146 is then spaced a pre-determined distance above the top of the cap 114.

Figure 4:
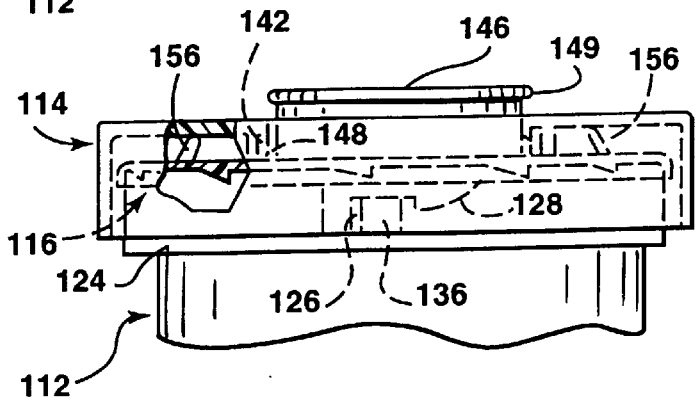
FIG. 4 is a similar view showing the cap secured to the container body.

As shown in FIG. 4 and the right hand side of FIG. 6, the engagement of the top portion 132 of the cap 114 with the posts 156 holds the outer peripheral portion 144 of the liner 116 firmly in engagement with the liner posts 156 so as to retain the outer peripheral portion 144 of the liner 116 in engagement with the upper edge of the wall 124 of the container body 112. Also, the outer side wall of the upwardly open U-shaped portion 150 of the cap liner 116 sealingly engages the inner surface of the peripheral wall 124 of the container body 112 to protect medication therein, as shown on the right hand side of FIG. 6.

During rotation of the cap 114 and liner 116 relative to the container body 112 when closing the container, the ribs 142 on the cap 114 engage the vertical surfaces **148*b* of the ratchet teeth 148 to cause the liner 116 to rotate with the cap 114, that is to say there is no rotation of the cap 114 relative to the liner 116 during closing movement. The projections 145 in the outer peripheral portion 144 of the liner 116 slide past the ratchet teeth 125 on the top of the wall 124 of the container body 112 during such movement. FIG. 8 shows the top of the container when the cap 114 is in the closed position, with the indicator arrow 172 on the central button 146 of the liner 116 pointing to the "NIGHT" sector on the label 170**, thus indicating that the last dose had been taken during the previous night.

The container can be opened in two ways, namely without pushing down on the central button 146 or with pushing down on the central button 146.

Figure 5:
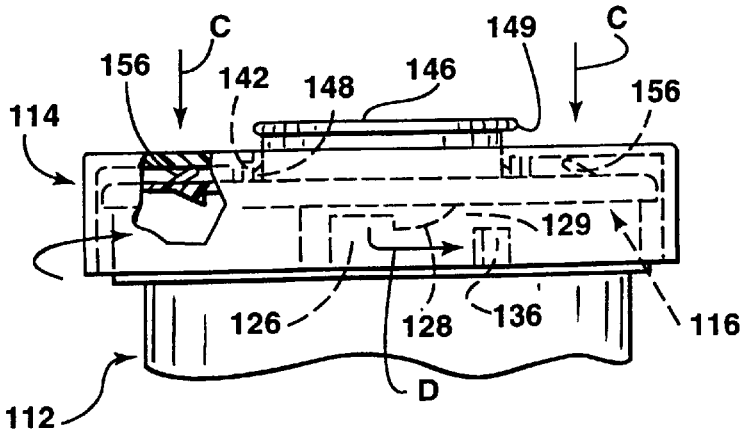
FIG. 5 is a similar view showing the cap being removed from the container body without pushing down on the central button of the cap.

To open the container without pushing down on the central button 146, as shown in FIG. 5 and the left hand side of FIG. 7, the cap 114 is pushed down (as indicated by the arrows C in these figures) a sufficient amount relative to the container body 112 to cause the cap lugs 136 to move downwardly out of the container recesses 126. The liner posts 156 are deflected to accommodate such downward movement of the cap 114. With the downward pressure maintained, the cap 114 is rotated anti-clockwise relative to the container body 112, as indicated by the arrow D in FIG. 5, to cause the cap lugs 136 to move laterally away from the recesses 126 and then past the adjacent ramps 128 to the spaces 129. The cap 114 can then be removed from the container body 112.

During this opening movement, the cap 114 is pushing the outer peripheral portion 144 of the liner 116 (through the posts 156) against the upper edge of the peripheral wall 124 of the container body 112. The projections 145 in the liner peripheral portion 144 engage the ratchet teeth 125 on the upper edge of the container peripheral wall 124 to prevent the liner 116 from rotating relative to the container body 112 while the cap 114 is being rotated in the anti-clockwise opening direction. The cap 114 therefore rotates relative to the liner 116 to cause the indicator arrow 172 on the central button 146 of the liner 116 to now point to the "MORN" sector, thereby indicating that the last dose was taken in the morning. Thus, indexing occurs when the container is being opened, not when it is being closed.

During the opening movement, the ribs 142 on the cap 114 snap past the ratchet teeth 148 on the annular wall 147 of the central button portion 146 of the liner 116. The snap of the cap ribs 142 past the liner ratchet teeth 148 during the opening movement produces a distinct "click", thereby indicating that the cap 114 has in fact been moved to the open position. The "click" is caused because the inclined lower ends 142*a* of the ribs 142 ride up the inclined upper surfaces 148*a* of the ratchet teeth 148 by depressing the central button portion 146 and resiliently deflecting adjacent portions of the liner 116 such that, when the lower ends 142*a* of the ribs 142 move past the upper surfaces 148*a* of the teeth 148, the central button portion 146 and adjacent deflected portions of the liner 110 snap back to their original position and configuration to cause the "click". This is an advantage over known containers of the kind which merely have cap lugs which engage in recesses in a container body and with which no such "click" occurs. It has been found that the previously described shaping (inclination) of the upper surfaces 148*a* of the ratchet teeth 148 and the lower ends 142*a* of the ribs 142 produce vertical and horizontal forces which facilitate the opening movement described above.

It should be noted that it is possible to omit the liner projections 145 and container ratchet teeth 125 in embodiments where the liner 116 is pushed with a sufficient force against the upper edge of the container wall 124 during opening movement such that the liner 116 is prevented from rotating relative to the container body 112.

As shown on the right hand side of FIG. 7, the container may alternatively be open by first pushing down on the central button 146, with consequent resilient deflection of the liner 116 independently of the cap 114 as shown. This permits the cap 114 to be easily moved downwardly relative to the container body 112, by gravity or by engagement of the bead 149 on the button 146 with the top of the cap 114, to release the lugs 136 from the recesses 126 for subsequent anti-clockwise rotation of the cap 114 relative to the container body 112 (and to the liner 116) as before. This manner of opening is advantageous in that it produces less friction between the cap 114 and the container body 112 because the ratchet teeth 148 on the central button 146 become partially disengaged from the ribs 142 on the cap 114 and the posts 156 become disengaged from the central portion 132 of the cap 114 to facilitate anti-clockwise rotation of the cap 114.

As previously mentioned, the body liner 118 is disposable. A predetermined amount of medication can be placed in a body liner 118 and the upper open end sealed by means of a removable seal (not shown), the nature of which will be readily apparent to a person skilled in the art, thereby providing pre-packaged medication which is tamper-evident. A pharmacist supplying the medication will leave the seal on when putting the pre-packed product in the container 112, so that the seal can subsequently be removed by the consumer who consequently knows that the correct amount of medication has been provided.

The bottom of the upwardly open U-shape portion 150 of the cap liner 116 may sealingly engage the flange 164 of the body liner 112 to protect the product therein. Also, the ratchet teeth 148 on the side wall 147 of the central button portion 146 of the cap 116 may be replaced by vertical ribs extending for the whole height of the side wall, with the ribs 142 on the interior of the inner wall 140 of the cap 114 being replaced by resiliently flexible projections engageable with the vertical ribs on the central button portion 146 to achieve the ratchet effect.

A medication identification label (not shown) may be attached to the tubular body 160 of the disposable body liner 118, with the container body 112 being transparent so that the label is visible therethrough. The label is also protected by the container body 112.

Although in the described embodiment the central button portion 146 normally projects above the top of the cap 114, the central button portion 146 (without a bead 149) may alternatively be level with or slightly below the top of the cap 114.

Figure 10:
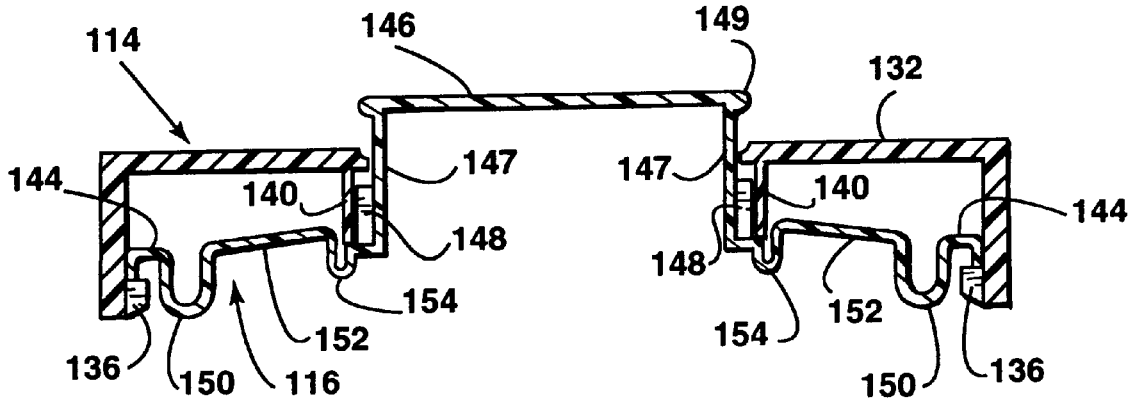
FIG. 10 is a sectional side view of a cap and cap liner in accordance with another embodiment of the invention, namely with the pins on the cap liner of the previous embodiment having been omitted.

As shown in FIG. 10, the posts 156 on the cap liner 116 may be omitted. In this case, the engagement which previously took place between the top portion 132 of the cap 114 and the posts 156 now occurs between the lower end of the inner wall 140 of the cap 114 and a circumferential ledge portion 155 on the cap liner 116 which extends radially outwardly of the ratchet teeth 148 at their lower ends.

Also, in the described embodiments, there are twelve ratchet teeth 148, twelve ribs 142, six lugs 136 and six recesses 126. As will be readily apparent to a person skilled in the art, the numbers of such parts may be varied in a manner which is consistent with the desired function thereof in accordance with the invention.

Other embodiments of the invention will also be readily apparent to a person skilled in the art, the scope of the invention being defined in the appended claims.

I claim:

1. A medication container having:

a tubular container body having an open upper end, a cap detachably securable to the upper end of the container body by clockwise rotation relative thereto, the cap and the container body having mutually engageable stops preventing anti-clockwise opening rotation of the cap relative to the container body when the cap is in an upper position relative to the container body, and a cap liner of resilient material within the cap and having a peripheral portion engageable with the upper end of the container body to close said upper end, the cap liner also having a central button portion in a central aperture in the cap for manual engagement by a person wishing to open the container, and the cap normally being engaged by the cap liner, when the cap is detachably secured to the container body, to maintain the cap in the upper position relative to the container body, whereby downward manual pressure on the central button portion of the cap liner causes resilient deformation of the cap liner away from the cap to permit the cap to be depressed from its upper position and thereby permit counter-clockwise opening rotation of the cap relative to the container body.

2. A medication container according to claim 1 wherein the cap liner has a series of circumferentially spaced posts extending upwardly therefrom for engagement with the cap, when the cap is detachably secured to the container body, to maintain the cap in the upper position relative to the container body, whereby downward pressure on the central button portion of the cap liner causes resilient deformation of the cap liner away from the cap to permit the cap to be depressed from its upper position and thereby permit counter-clockwise opening rotation of the cap relative to the container body.

3. A medication container according to claim 1 wherein the peripheral portion of the cap liner has a downwardly open U-shape for engaging the upper end of the container body to close said upper end, the peripheral portion merging in the radially inward direction with a first liner portion of upwardly open U-shape which merges in turn with an intermediate liner portion of downwardly open U-shape which merges in turn with a second liner portion of upwardly open U-shape, the second liner portion of upwardly open U-shape merging with a lower end of the downwardly extending wall of the central button portion.

4. A medication container according to claim 3 wherein the cap liner has a series of circumferentially spaced posts extending upwardly from the intermediate liner portion of downwardly open U-shape for engagement with the cap.

5. A medication container according to claim 1 wherein the container body has a radially outwardly extending flange portion and a peripheral wall extending upwardly from a radially outer edge thereof, said peripheral wall having an upper edge providing the upper end of the container engageable by a peripheral portion of the cap liner, the medication container also having a detachable body liner located within the container body and having a tubular liner body with a closed lower end and an open upper end, the upper end of the body liner having a radially outwardly extending flange located on the radially outwardly extending flange portion of the container body.

6. A medication container according to claim 5 wherein the cap liner sealingly engages an inner surface of the peripheral wall of the container body when the cap is in the closed position.

7. A medication container according to claim 1 wherein the cap has a downward extending wall adjacent to the aperture and engaged by the cap liner, when the cap is detachably secured to the container body, to maintain the cap in the upper position relative to the container body, whereby downward manual pressure on the central button portion of the cap liner causes resilient deformation of the cap liner away from the downwardly extending wall of the cap to permit the cap to be depressed from its upper position and thereby permit counter-clockwise opening rotation of the cap relative to the container body.

8. A medication container according to claim 7 wherein the central button portion has a circumferentially extending lateral projection which engages the cap during downward movement of the central button portion to depress the cap from its upper position, the circumferentially extending lateral projection being normally spaced above the top of the cap by a pre-determined distance when the cap is secured to the container body to permit axial movement of the cap liner relative to the cap.

9. A medication container according to claim 7 wherein the cap and the cap liner have inter-engaging mechanism provided on an internal surface of the downwardly extending wall of the cap and an external surface of a peripheral wall of the central button portion of the cap liner to prevent rotational movement therebetween when the cap is rotated in one direction relative to the container body and permitting relative movement therebetween when the cap is rotated in an opposite direction relative to the container body, the cap and the cap liner having indicia which indicates the next dosage time when the cap is rotated in said opposite direction.

10. A medication container according to claim 9 wherein resilient deformation of the cap liner away from the downwardly extending wall of the cap caused by downward manual pressure on the central button portion of the cap at least partially disengages the inter-engaging mechanism to facilitate the opening movement of the cap.

11. A medication container according to claim 9 wherein the inter-engaging mechanism prevents relative movement between the cap and the cap liner when the cap is rotated in the clockwise closing direction and permits relative rotation between the cap and the cap liner when the cap is rotated in the anti-clockwise opening direction.

12. A medication container according to claim 11 wherein, when the cap is detached from the container body, downward manual pressure on the central button portion of the cap liner causes axial movement of the cap liner relative to the cap to at least partly disengage the inter-engaging mechanism and permit relative rotation between the cap and the cap liner.

13. A medication container according to claim 9 wherein the inter-engaging mechanism comprises circumferentially spaced ribs on said wall of the cap or the cap liner and a series of ratchet teeth engageable therewith extending around the said wall of the cap liner or the cap.

14. A medication container according to claim 13 wherein the ratchet teeth are located only on a lower portion of the peripheral wall of the cap liner and have upper surfaces engaged by lower ends of ribs on the outer surface of the downwardly extending wall of the cap to provide the ratchet action.

15. A medication container according to claim 14 wherein the upper surfaces of the ratchet teeth are circumferentially upwardly inclined and radially outwardly downwardly inclined and the lower ends of the ribs are inclined in a complementary manner.

* * * * *